US008702099B2

(12) United States Patent
Vanderberg

(10) Patent No.: US 8,702,099 B2
(45) Date of Patent: Apr. 22, 2014

(54) LIGHT-UP SHUFFLEBOARD EQUIPMENT

(75) Inventor: Matthew Alexander Vanderberg, Charlotte, NC (US)

(73) Assignee: M & C Innovations, LLC, Charlotte, NC (US)

( * ) Notice: Subject to any disclaimer, the term of this patent is extended or adjusted under 35 U.S.C. 154(b) by 361 days.

(21) Appl. No.: 13/195,238

(22) Filed: Aug. 1, 2011

(65) Prior Publication Data

US 2012/0025459 A1 Feb. 2, 2012

Related U.S. Application Data

(63) Continuation-in-part of application No. 13/194,494, filed on Jul. 29, 2011.

(60) Provisional application No. 61/369,465, filed on Jul. 30, 2010.

(51) Int. Cl.
*A63F 7/00* (2006.01)

(52) U.S. Cl.
USPC ..... 273/126 A

(58) Field of Classification Search
USPC ..... 273/126 R, 126 A; 473/588; 315/76; D21/321
See application file for complete search history.

(56) References Cited

U.S. PATENT DOCUMENTS

| | | | | | |
|---|---|---|---|---|---|
| 2,440,042 | A | * | 4/1948 | Friedman | 315/76 |
| 2,530,896 | A | | 11/1950 | Metz | |
| 2,585,153 | A | | 2/1952 | Metz | |
| 2,606,030 | A | | 8/1952 | Tjomsland | |
| 2,998,251 | A | * | 8/1961 | McShane | 473/588 |
| 3,102,727 | A | | 9/1963 | Rice | |
| 3,403,911 | A | * | 10/1968 | Horst | 273/126 R |
| 4,135,324 | A | * | 1/1979 | Miller et al. | 446/47 |
| 4,183,536 | A | * | 1/1980 | Platt | 473/570 |
| 4,607,850 | A | * | 8/1986 | O'Riley | 473/588 |
| 4,846,475 | A | | 7/1989 | Newcomb et al. | |
| 4,968,036 | A | | 11/1990 | Von Der Mark | |
| 5,083,799 | A | * | 1/1992 | Thill | 473/588 |
| D350,783 | S | | 9/1994 | Bacon | |
| 5,564,698 | A | * | 10/1996 | Honey et al. | 473/570 |
| 6,126,561 | A | * | 10/2000 | Mark | 473/588 |
| 6,279,905 | B1 | | 8/2001 | Malavazos et al. | |
| 6,854,728 | B2 | | 2/2005 | Oister et al. | |
| 7,261,432 | B1 | | 8/2007 | Habitz | |
| 7,621,833 | B2 | * | 11/2009 | Proulx et al. | 473/588 |
| 2003/0119613 | A1 | | 6/2003 | Samuel et al. | |
| 2004/0220001 | A1 | * | 11/2004 | Oister et al. | 473/570 |

(Continued)

OTHER PUBLICATIONS

Information Disclosure Statement (IDS) Letter Regarding Common Patent Application(s), dated Nov. 14, 2012.

*Primary Examiner* — Raleigh W Chiu
(74) *Attorney, Agent, or Firm* — Tillman Wright, PLLC; Chad D. Tillman; Jeremy C. Doerre

(57) ABSTRACT

A light-up shuffleboard disc includes a lighting component, and a disc component containing the lighting component. The disc component is constructed so as to allow light from the lighting component to illuminate the shuffleboard disc when the lighting component is activated. A light-up shuffleboard set includes a plurality of light-up shuffleboard discs, some of which may be illuminated by a first color for representing a first player, and some of which may be illuminated by a second color for representing a second player.

20 Claims, 9 Drawing Sheets

(56) References Cited

U.S. PATENT DOCUMENTS

2007/0075486 A1* 4/2007 Silva ..... 273/126 R
2007/0075487 A1* 4/2007 Silva ..... 273/126 R
2007/0275801 A1* 11/2007 Proulx et al. ..... 473/588
2012/0025459 A1* 2/2012 Vanderberg ..... 273/126 A
2012/0025460 A1 2/2012 Vanderberg

* cited by examiner

20

20

LIGHT-UP SHUFFLEBOARD EQUIPMENT

CROSS-REFERENCE TO RELATED APPLICATION

The present application is a U.S. continuation-in-part patent application of, and claims priority under 35 U.S.C. §120 to, U.S. nonprovisional patent application Ser. No. 13/194,494, filed Jul. 29, 2011, which '494 patent application is a nonprovisional application of, and claims priority under 35 U.S.C. §119(e) to, U.S. provisional patent application Ser. No. 61/369,465, filed Jul. 30, 2010. Additionally, the present application is a nonprovisional application of, and claims priority under 35 U.S.C. §119(e) to, U.S. provisional patent application Ser. No. 61/369,465, filed Jul. 30, 2010. Each of the foregoing patent applications, and any publications thereof and any patents issuing therefrom, are hereby incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to light-up shuffleboard equipment.

Shuffleboard is a well known game. As anyone who has ever tried will know, however, it can be challenging to play shuffleboard when it is dark.

A need exists for improvement in shuffleboard equipment. This, and other needs, are addressed by one or more aspects of the present invention.

SUMMARY OF THE INVENTION

The present invention includes many aspects and features. Moreover, while many aspects and features relate to, and are described in, the context of light-up shuffleboard equipment, the present invention is not limited to use only in this context, as will become apparent from the following summaries and detailed descriptions of aspects, features, and one or more embodiments of the present invention.

Accordingly, in a aspect of the present invention a light-up shuffleboard disc includes a lighting component, and a disc component including a cavity for receiving the lighting component. The disc component is constructed so as to allow light from the lighting component to illuminate the shuffleboard disc when the lighting component is received within the cavity of the disc component.

In a feature of this aspect, the disc component is configured to retain the lighting component within the cavity.

In a feature of this aspect, the disc component is configured to retain the lighting component within the cavity via threaded engagement of walls of the cavity with an outer portion of the lighting component.

In a feature of this aspect, the cavity includes a recess proximate a bottom thereof.

In a feature of this aspect, the lighting component includes a light source, and the recess of the disc component is sized and dimensioned to accommodate the light source when the lighting component is fully received within the cavity of the disc component.

In a feature of this aspect, a bottom of the cavity is partially defined by a planar surface, and wherein, when the lighting component is fully received within the cavity of the disc component, an activation button of the lighting component is depressed via contact with the planar surface, thereby activating the light source of the lighting component.

In a feature of this aspect, the lighting component comprises an incandescent light bulb.

In a feature of this aspect, the lighting component comprises a light emitting diode (LED) bulb.

In a feature of this aspect, the lighting component comprises a fluorescent bulb.

In a feature of this aspect, the shuffleboard disc is configured to be transitioned between a first state, in which the lighting component is fully received within the cavity and the lighting component is activated, and a second state, in which the lighting component is not fully received within the cavity and the lighting component is not activated.

In another aspect of the present invention, a method of activating a light-up shuffleboard disc includes the steps of: activating a light source of a lighting component configured for receipt within a cavity of a shuffleboard disc; and inserting the lighting component into the cavity of a shuffleboard disc such that the lighting component is removably secured therein.

In another aspect of the present invention, a method of activating a light-up shuffleboard disc includes activating a light source of a lighting component configured for receipt within a cavity of a shuffleboard disc; and inserting the lighting component into the cavity of a shuffleboard disc such that the lighting component is removably secured therein.

In a feature of this aspect, the cavity and the lighting component are both threaded, and the lighting component is configured to be screwed into the cavity, and wherein the step of inserting the lighting component into the cavity of the shuffleboard disc comprises screwing the lighting component into the cavity such that threads of the lighting component are engaged with threads of the shuffleboard disc.

In a feature of this aspect, the step of activating the light source comprises hitting a switch.

In another aspect of the present invention, a method of activating a light-up shuffleboard disc includes inserting a lighting component into a cavity of a shuffleboard disc; wherein the lighting component is configured such that a light source of the lighting component is automatically activated when the lighting component is inserted a certain extent into the cavity of the shuffleboard disc.

In a feature of this aspect, a switch of the lighting component is configured to engage a bottom surface of the cavity when the lighting component is substantially entirely received within the cavity, the switch being configured to effect lighting of the light source. In at least some implementations, the cavity and the lighting component are both threaded, and the lighting component is configured to be screwed into the cavity, and wherein the step of inserting the lighting component into the cavity of the shuffleboard disc comprises screwing the lighting component into the cavity such that threads of the lighting component are engaged with threads of the shuffleboard disc.

In another aspect of the present invention, a method of activating a light-up shuffleboard disc includes rotating a lighting component received within a cavity of a shuffleboard disc in a first direction; wherein the lighting component and the shuffleboard disc are configured such that rotation of the lighting component in the first direction effects entry of the lighting component within the cavity of the shuffleboard disc, and rotation of the lighting component in a second direction effects withdrawal of the lighting component from the cavity of the shuffleboard disc; and wherein a light source of the lighting component is configured to be automatically activated when the lighting component is disposed a certain extent within the cavity of the shuffleboard disc.

In a feature of this aspect, the cavity and the lighting component are both threaded, and the lighting component is configured to be screwed into the cavity, and wherein the step of effecting rotation of the lighting component comprises screwing the lighting component into the cavity such that threads of the lighting component are engaged with threads of the shuffleboard disc.

In another aspect of the present invention, a method of deactivating a light-up shuffleboard disc includes removing a lighting component from a cavity of a shuffleboard disc; and deactivating a light source of the lighting component.

In another aspect of the present invention, a method of deactivating a light-up shuffleboard disc includes rotating a lighting component received within a cavity of a shuffleboard disc in a second direction; wherein the lighting component and the shuffleboard disc are configured such that rotation of the lighting component in a first direction effects entry of the lighting component within the cavity of the shuffleboard disc, and rotation of the lighting component in the second direction effects withdrawal of the lighting component from the cavity of the shuffleboard disc; and wherein a light source of the lighting component is configured to be automatically activated when the lighting component is disposed a certain extent within the cavity of the shuffleboard disc, and is configured to be automatically deactivated when the lighting component is disposed less than the certain extent within the cavity of the shuffleboard disc.

In a feature of this aspect, the cavity and the lighting component are both threaded, and the lighting component is configured to be screwed into and out of the cavity, and wherein the step of effecting rotation of the lighting component comprises screwing the lighting component out of the cavity.

In another aspect of the present invention, a method of using a light-up shuffleboard disc includes activating a light source of a lighting component of a shuffleboard disc; and pushing, by a player using a tang, the shuffleboard disc towards a scoring zone.

In another aspect of the present invention, a method of using a light-up shuffleboard disc includes activating a light-up shuffleboard disc by rotating a lighting component received within a cavity of the shuffleboard disc in a first direction, wherein the lighting component and the shuffleboard disc are configured such that rotation of the lighting component in the first direction effects entry of the lighting component within the cavity of the shuffleboard disc, and rotation of the lighting component in a second direction effects withdrawal of the lighting component from the cavity of the shuffleboard disc, and wherein a light source of the lighting component is configured to be automatically activated when the lighting component is disposed a certain extent within the cavity of the shuffleboard disc; pushing, by a player using a tang, the shuffleboard disc towards a scoring zone.

In another aspect of the present invention, a light-up shuffleboard court includes a playing surface comprising one or more scoring zones; one or more light sources, the shuffleboard court being configured such that, when one of the one or more light sources is lit, light from that light source is visible to a player utilizing the shuffleboard court.

In a feature of this aspect, at least one of the one or more light sources is disposed below the playing surface.

In a feature of this aspect, at least one of the one or more light sources is disposed on the playing surface.

In a feature of this aspect, at least one of the one or more light sources is disposed in the playing surface.

In a feature of this aspect, at least one of the one or more light sources comprises an incandescent light bulb.

In a feature of this aspect, at least one of the one or more light sources comprises a light emitting diode (LED) bulb.

In a feature of this aspect, at least one of the one or more light sources comprises a fluorescent bulb.

In a feature of this aspect, at least one of the one or more light sources is configured to be activated based on a position of a shuffleboard disc in one of the one or more scoring zones.

In another aspect of the present invention, a method of using a light-up shuffleboard court includes effecting activation of one or more light sources of a light-up shuffleboard court; pushing, by a player using a tang, a shuffleboard disc along a surface of the light-up shuffleboard court towards a scoring zone.

In a feature of this aspect, at least one of the one or more light sources are configured to illuminate at least a portion of the scoring zone.

In another aspect of the present invention, a light-up shuffleboard set includes a light-up shuffleboard court including a playing surface comprising one or more scoring zones, and one or more light sources, the shuffleboard court being configured such that, when one of the one or more light sources is lit, light from that light source is visible to a player utilizing the shuffleboard court; and a plurality of light-up shuffleboard discs, each light-up shuffleboard disc including a lighting component comprising a light source.

In a feature of this aspect, the light-up shuffleboard set is configured for lighting of at least one of the one or more light sources of the shuffleboard court when one of the light-up shuffleboard discs is disposed within an area of the playing surface of the light-up shuffleboard court. In at least some implementations, the area of the playing surface comprises at least a portion of one of the one or more scoring zones.

In a feature of this aspect, each light-up shuffleboard disc is configured for lighting when disposed within an area of the playing surface of the shuffleboard court. In at least some implementations, the area of the playing surface comprises at least a portion of one of the one or more scoring zones.

In a feature of this aspect, a first subset of the plurality of light-up shuffleboard discs are configured to light up a first color, and a second subset of the plurality of light-up shuffleboard discs are configured to light up a second color.

In another aspect of the present invention, a method of using a light-up shuffleboard set includes pushing, by a player using a tang, a light-up shuffleboard disc along a playing surface of a light-up shuffleboard court towards a scoring zone of the light-up shuffleboard court; wherein the light-up shuffleboard disc is configured for lighting of a light source of the light-up shuffleboard disc when the light-up shuffleboard disc is disposed within a certain area of the playing surface of the light-up shuffleboard court.

In a feature of this aspect, the certain area of the playing surface comprises at least a portion of the scoring zone.

In another aspect of the present invention, a method of using a light-up shuffleboard set includes pushing, by a player using a tang, a light-up shuffleboard disc along a playing surface of a light-up shuffleboard court towards a scoring zone of the light-up shuffleboard court; wherein the light-up shuffleboard court is configured for lighting of a light source of the light-up shuffleboard court when the light-up shuffleboard disc is disposed within a certain area of the playing surface of the light-up shuffleboard court.

In a feature of this aspect, the certain area of the playing surface comprises at least a portion of the scoring zone.

In a feature of this aspect, the light-up shuffleboard disc is configured for lighting of a light source of the light-up shuffleboard disc when the light-up shuffleboard disc is disposed within the certain area of the playing surface of the light-up shuffleboard court.

In another aspect of the present invention, a method for a light-up shuffleboard set includes determining that a shuffleboard disc is disposed within a certain area of a shuffleboard court; and, in response to the determining step, automatically effecting lighting of a light source of the shuffleboard disc.

In another aspect of the present invention, a method for a light-up shuffleboard set includes determining that a shuffleboard disc is disposed within a certain area of a shuffleboard court; and, in response to the determining step, automatically effecting lighting of a light source of the shuffleboard court.

In another aspect of the present invention, a light-up shuffleboard set includes a light-up shuffleboard court and a plurality of light-up shuffleboard discs.

In addition to the aforementioned aspects and features of the present invention, it should be noted that the present invention further encompasses the various possible combinations and subcombinations of such aspects and features.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
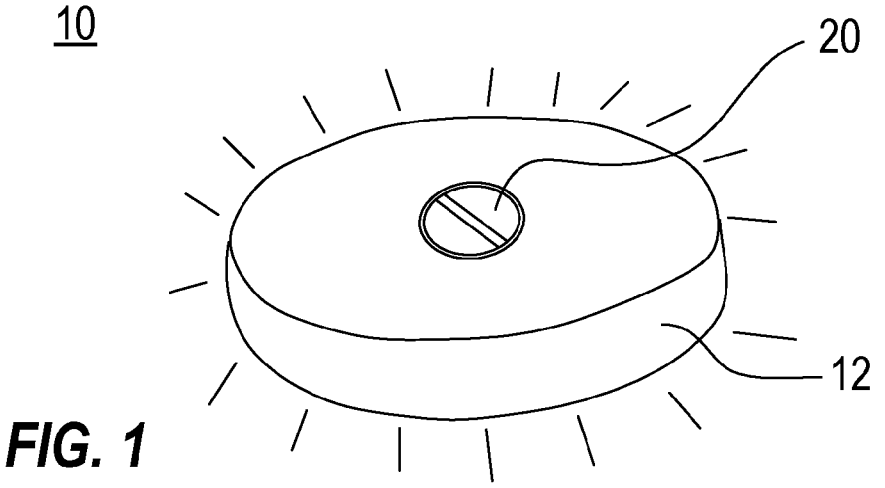
FIGS. 1-3 illustrates an embodiment of a light-up shuffleboard disc in accordance with one or more aspects of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Turning now to the figures, FIG. 1 illustrates a light-up shuffleboard disc 10 in accordance with a preferred embodiment of one or more aspects of the present invention. The light-up shuffleboard disc 10 preferably is dimensioned in accordance with standard shuffleboard discs. For example, in a preferred implementation, the light-up shuffleboard disc 10 is 6 inches in diameter, 9/16 inch to 1 inch thick, and weighs 15 ounces when new. In preferred implementations, this weight takes into account all of the components described herein. However, it is contemplated that in at least some preferred implementations, the shuffleboard disc 10 is thicker than 1 inch to accommodate components contained therein. The light-up shuffleboard disc 10 comprises a disc component 12 and a lighting component 20. The lighting component 20 is configured to illuminate the shuffleboard disc 10 when received within a cavity 14 centrally located on the top face of the disc component 12. Specifically, the disc component 12 is preferably constructed to be partially, or wholly, transparent or translucent so as to allow light from the lighting component 20 to be visible from an exterior of the shuffleboard disc 10 when the lighting component 20 is received and activated within the cavity 14. Additionally, the color of illumination of the shuffleboard disc 10 can be predetermined by selecting a desired color of the light emitted by the light source 22; by selecting the color of the transparent or translucent material of the disc component 12; or both. It is further contemplated that the disc component 12 of alternative embodiments is at least partially constructed from a material configured to fluoresce in response to light.

Alternatively, or in addition thereto, the top of the lighting component 20 is constructed be partially, or wholly, transparent or translucent so as to allow light from the lighting component 20 to be visible from an exterior of the shuffleboard disc 10 when the lighting component 20 is received and activated within the cavity 14. Again, the color of illumination of the shuffleboard disc 10 can be predetermined by selecting a desired color of the light emitted by the light source 22; by selecting the color of the transparent or translucent material of the top of the lighting component 20; or both. It is further contemplated that the top of the lighting source 20 of alternative embodiments is at least partially constructed from a material configured to fluoresce in response to light.

Figure 2:
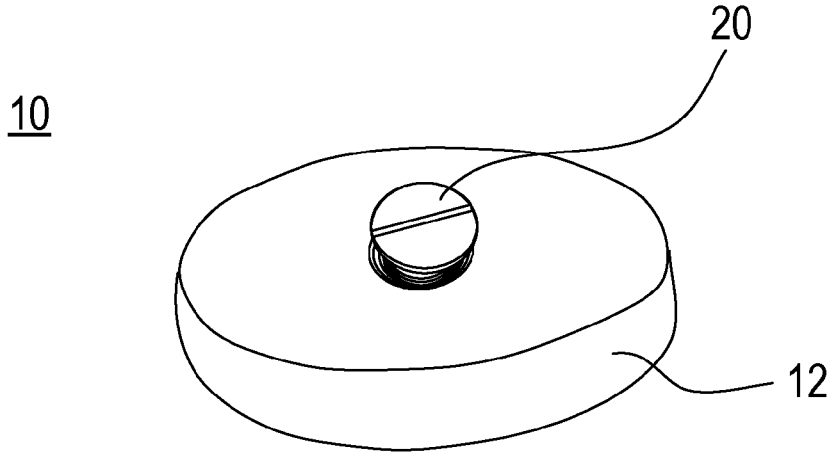
Figure 3:
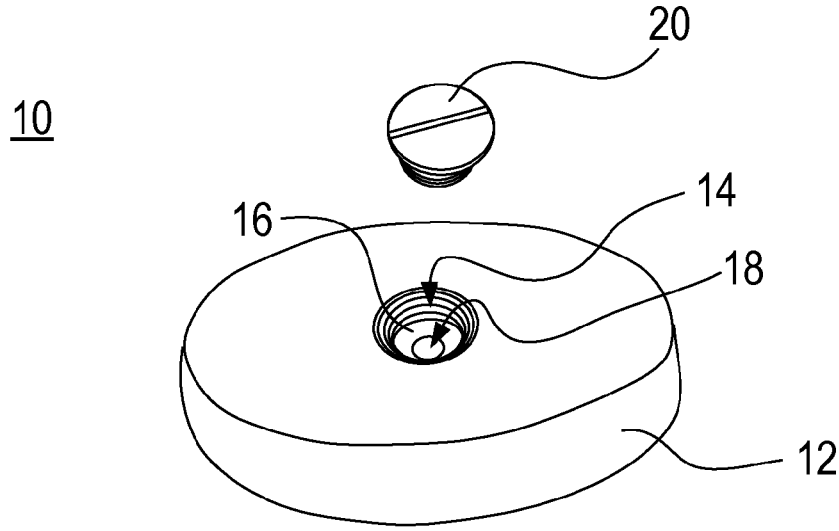

Walls of the cavity 14 are preferably configured for threaded engagement with an outer portion of the lighting component 20 such that the lighting component 20 is capable of being removably secured within the cavity 14, as illustrated via FIGS. 1-3.

FIG. 1 illustrates the shuffleboard disc 10 in a first state, in which lighting component 20 is fully received within the cavity 14 and is activated. In this state, the shuffleboard disc 10 can be characterized as being ready for play. From this state, the lighting component 20 can be removed via unscrewing of the lighting component 20 relative to the disc component 12. Such unscrewing could be utilized to effect transition from the state illustrated in FIG. 1, to the state illustrated in FIG. 2, in which the lighting component 20 is only partially received within the cavity 14. Further unscrewing could then be utilized to effect transition to the state illustrated in FIG. 3, in which the lighting component 20 has been entirely removed from the cavity 14.

Figure 4A:
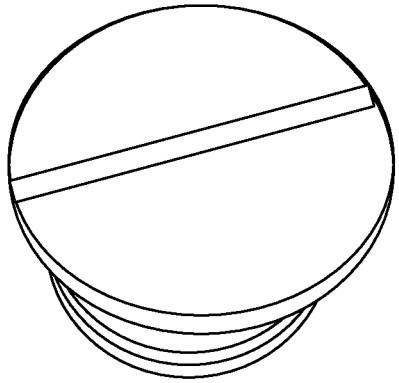
FIG. 4A is an enlarged perspective view of a top of the lighting component of the shuffleboard disc of FIGS. 1-3.
Figure 4B:
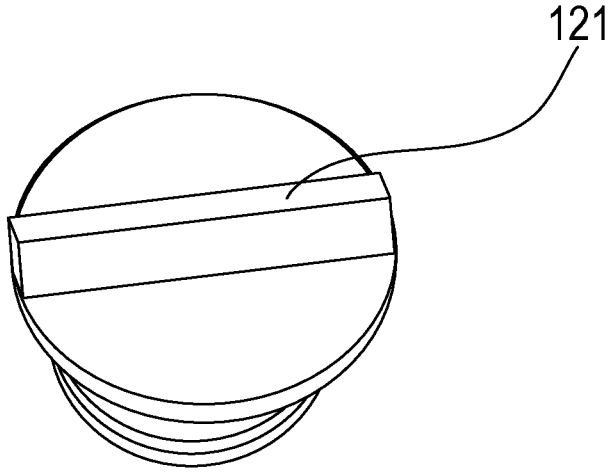
FIG. 4B is an enlarged perspective view of a top of an alternative lighting component.

FIG. 4A is an enlarged perspective view of a top of the lighting component 20. As illustrated, the top of the lighting component 20 preferably includes a screw cut which could be engaged, for example, by a slotted screwdriver or a coin for screwing or unscrewing the lighting component 20 into or out of the cavity 14 of the disc component 12. In at least some implementations, rather than a screw cut or other recess, an alternative lighting component 120 includes a raised ledge 121 that can be grasped by a user and which allows a user to rotate the lighting component 120 by hand, as illustrated in FIG. 4B.

Figure 5:
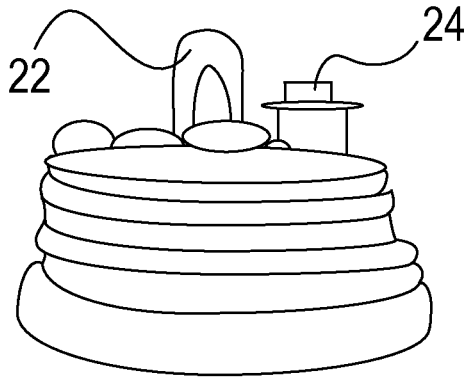
FIG. 5 is a side perspective view of the lighting component of FIG. 4 after it has been oriented upside down relative to the position in which it was illustrated in FIG. 4.
Figure 6:
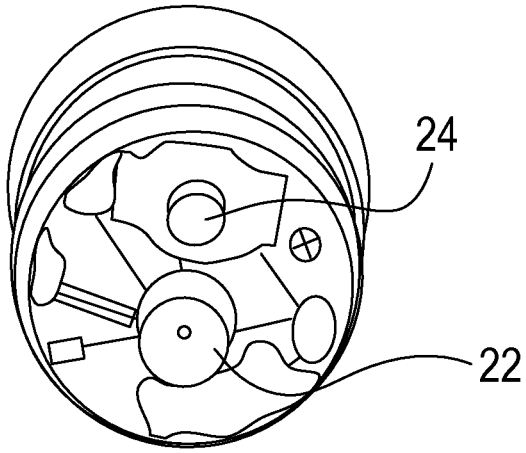
FIG. 6 is a perspective view of a bottom of the lighting component of FIG. 4.

FIG. 5 is a side perspective view of the lighting component 20 of FIG. 4A after it has been oriented upside down relative to the position in which it was illustrated in FIG. 4A, and FIG. 6 is a perspective view of a bottom of the lighting component 20 of FIG. 4A. As illustrated in FIGS. 5 and 6, the lighting component 20 preferably includes electronics including a light source 22 and a depressable button 24 configured for activation or deactivation of the light source 22.

The light source 22 preferably comprises an incandescent light bulb, although in at least some alternative preferred embodiments the light source 22 comprises a light emitting diode (LED) light bulb, a fluorescent bulb, or some other type of bulb. Furthermore, it is contemplated that the lighting component comprise a non-bulb light source.

Preferably, the button 24 is configured to activate (turn on) the light source 22 when depressed. Nonetheless, it is contemplated that in alternative embodiments the light source 22 of the lighting component 20 is activated (on) unless the button 24 is depressed.

Figure 8A:
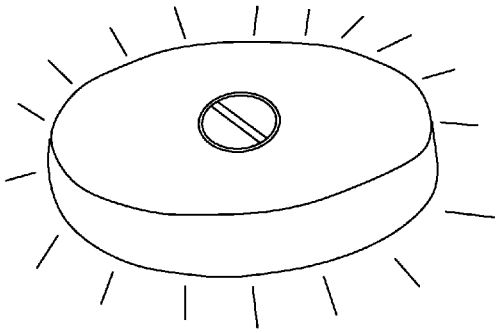
FIG. 8A illustrates the shuffleboard disc of FIGS. 1-3 in a state in which its lighting component is fully received within its cavity and is illuminating the disc.
Figure 8B:
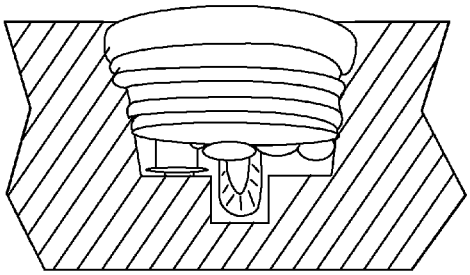
FIG. 8B is a fragmented partial cut-away view of the shuffleboard disc of FIG. 8A illustrating the depression of a button of a lighting component by a planar surface at the bottom of a cavity of the shuffleboard disc.

As illustrated in FIG. 3, the cavity 14 of the disc component 12 preferably includes a recess 18 defined in a planar surface 16 that itself partially defines a bottom of the cavity 14. The recess 18 is configured to accommodate the light source 22 of the lighting component 20 when the lighting component 20 is received and retained within the cavity 14, as illustrated in FIG. 8B.

It will be appreciated from the description hereinabove with respect to FIGS. 1-3 that the depth of the lighting component 20 within the cavity 14 is adjustable by screwing or unscrewing the lighting component 20 with respect to the disc component 12. The cavity 14 and lighting component 20 are sized and dimensioned such that, when the lighting component 20 is fully received within the cavity 14, the button 24 of the lighting component 20 is depressed by the planar surface 16 at the bottom of the cavity 14. FIG. 8A illustrates the shuffleboard disc 10 in this state when the lighting component 20 is fully received within the cavity 14, and FIG. 8B is a fragmented partial cut-away view illustrating depression of the button 24 by the planar surface 16 at the bottom of the cavity 14 in this state. As illustrated, the shuffleboard disc 10 is lit by activation of the light source 22 of the lighting component 20 upon depression of the button 24.

Figure 7A:
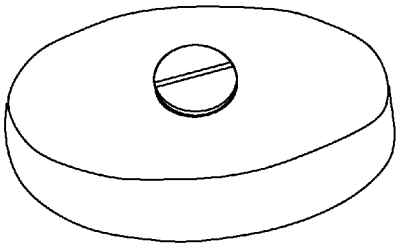
FIG. 7A illustrates the shuffleboard disc of FIGS. 1-3 in a state in which its lighting component is close to, but not quite, fully received within its cavity.
Figure 7B:
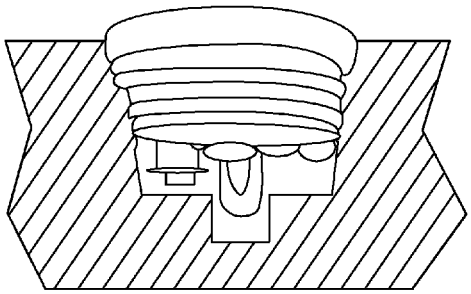
FIG. 7B is a fragmented partial cut-away view of the shuffleboard disc of FIG. 7A illustrating the lack of depression of a button of a lighting component by a planar surface at the bottom of a cavity of the shuffleboard disc.

By way of contrast, FIG. 7A illustrates the shuffleboard disc 10 in a state in which the lighting component 20 is close to, but not quite, fully received within the cavity 14, and FIG. 7B is a fragmented partial cut-away view illustrating lack of depression of the button 24 by the planar surface 16 at the bottom of the cavity 14 in this state.

Thus, the shuffleboard disc 10, in implementations in which depression of the button 24 is configured to effect activation of the light source 22, is configured such that a user can transition the shuffleboard disc 10 to a lighted state by fully screwing in lighting component 20 into cavity 14.

Figure 9:
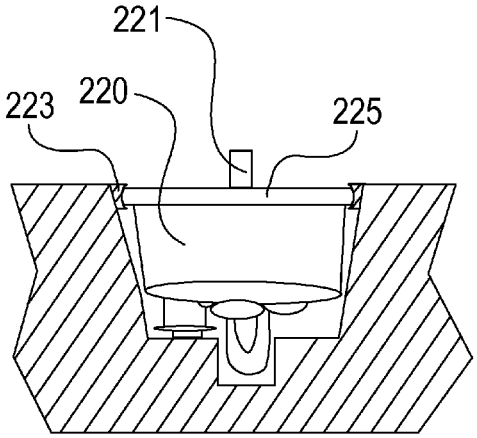
FIG. 9 illustrates a lighting component which includes a snap fit top configured to engage one or more snap fit members of a shuffleboard disc.

One or more implementations of a light-up shuffleboard disc have been described hereinabove wherein a lighting component is received and retained within a cavity via threaded engagement. In at least some alternative implementations, however, a lighting component is received and retained within a cavity in another manner, such as, for example, via a snap-fit connection, as illustrated in the fragmented partial cut-away view of FIG. 9. Specifically, FIG. 9 illustrates a lighting component 220 which includes a snap fit top 225 configured to engage one or more snap fit members 223 of a shuffleboard disc. In FIG. 9, the snap fit top 225 is securely engaged with the one or more snap fit members 223. The snap fit top 225 includes a raised ledge 221 that can be grasped by a user to remove it from its snap-fit engagement.

Figure 10A:
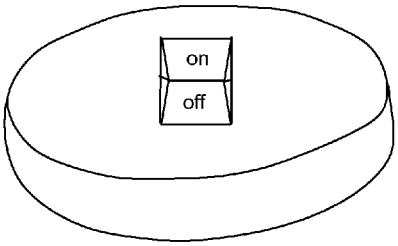
FIGS. 10A-B illustrate a shuffleboard disc is configured to include a light source disposed therein that is not a part of an easily removable lighting component, and is activated through an on/off button or switch of the disc component.
Figure 10B:
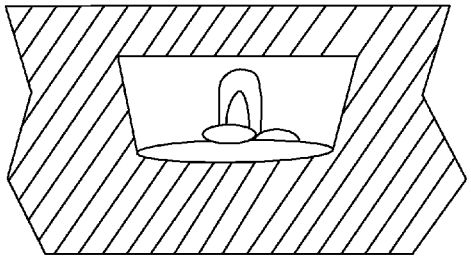

Further, in at least some implementations, a shuffleboard disc is configured to include a light source disposed therein that is not a part of an easily removable lighting component, and is activated through an on/off button or switch of the disc component, as illustrated in FIG. 10A, and in FIG. 10B, which is a fragmented partial cut-away view.

Figure 11A:
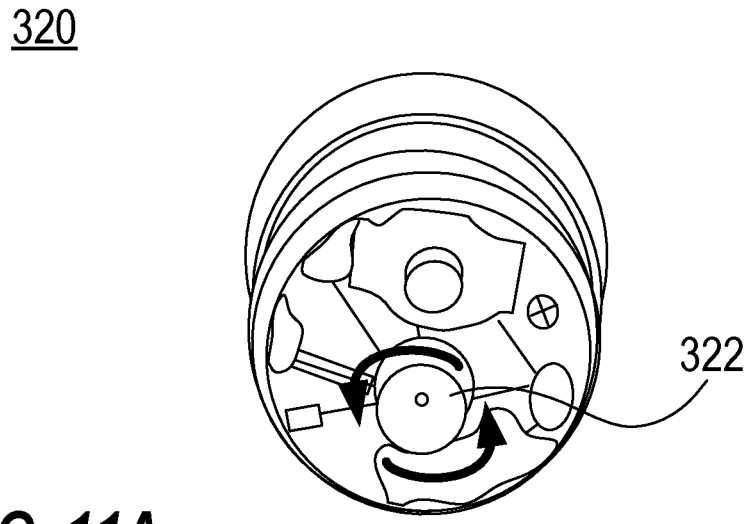
FIGS. 11A-B illustrate a lighting component which includes a removable bulb.
Figure 11B:
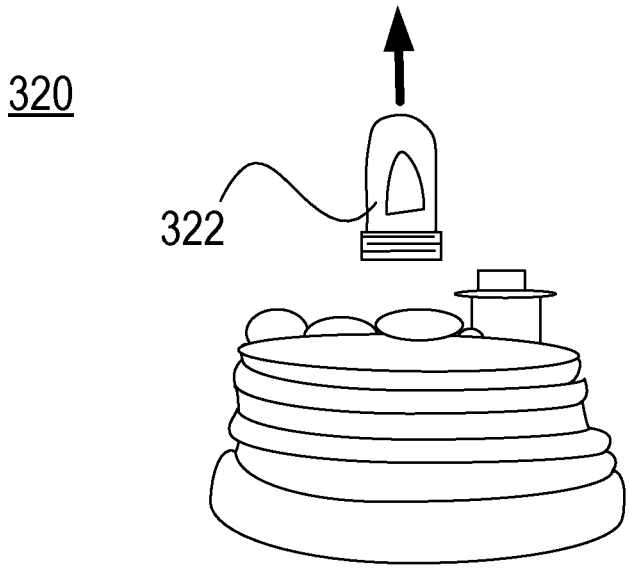
Figure 12:
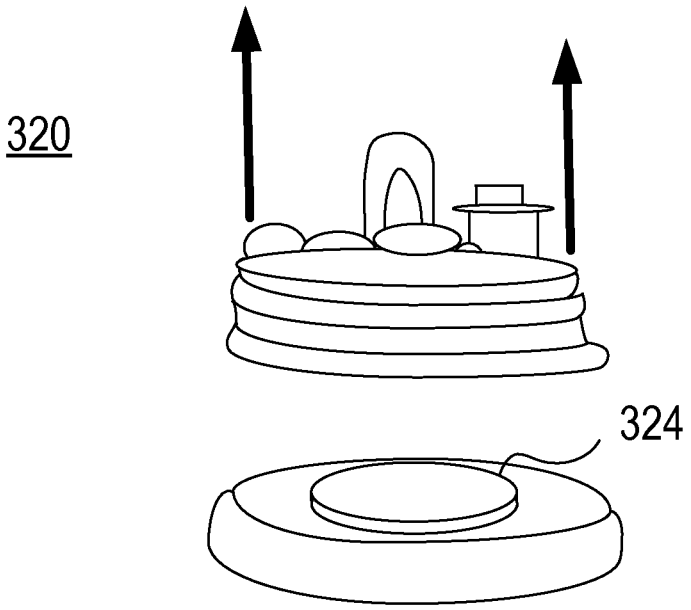
FIG. 12 illustrates a lighting component which includes a removable battery.

In at least some such preferred implementations, the shuffleboard disc is configured such that a battery and/or a light source contained within the shuffleboard disc can be easily changed. For example, FIGS. 11A-B illustrate a lighting component 320 which includes a removable bulb 322. The bulb 322 can be removed by being rotated as illustrated in FIG. 11A. Thereafter, the bulb 322 can be replaced with another bulb. Similarly, a portion of the lighting component 320 can be removed from the top of the lighting component 320 to allow for replacement of a battery 324 disposed in the lighting component 320, as illustrated in FIG. 12.

In preferred methods in accordance with one or more aspects of the present invention, a plurality of light-up shuffleboard discs are utilized with a convention shuffleboard court. In such methods, the illumination provided by the light-up shuffleboard discs aids in identifying and locating the shuffleboard disc during twilight, dusk, or at night, and aids in seeing the area immediately surrounding the shuffleboard disc. Additionally, by providing two groups of shuffleboard discs, each group having a different color of illumination, the shuffleboard discs of two competing players can be readily identified and distinguished during twilight, dusk, or at night.

Figure 13:
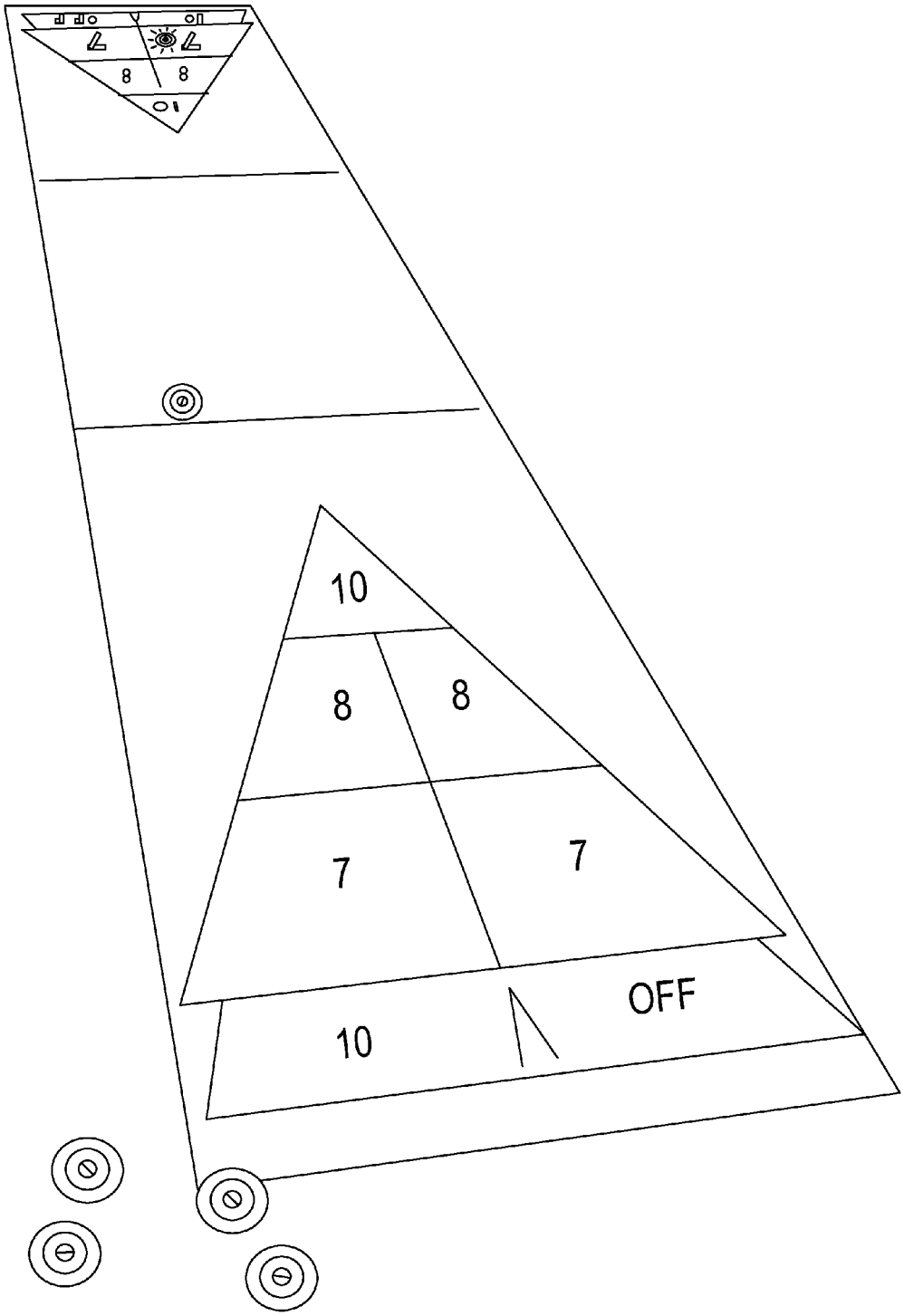
FIGS. 13-14 illustrate embodiments of a light-up shuffleboard court in accordance with one or more aspects of the present invention.

In other preferred methods, a plurality of light-up shuffleboard discs are utilized in combination with a light-up shuffleboard court. FIG. 13 illustrates an embodiment of a light-up shuffleboard court in accordance with one or more aspects of the present invention. In this respect, one or more sections of the light-up shuffleboard court are configured to light-up to facilitate play in the dark. In at least some preferred implementations, incandescent lighting technology, fluorescent lighting technology, and/or LED lighting technology are utilized to light the light-up shuffleboard court.

In at least some preferred implementations, the shuffleboard court and one or more shuffleboard discs are configured such that lighting up of one or both will be effected based on placement of the shuffleboard disc on a certain section of the shuffleboard court. For example, in some implementations, this is accomplished via use of magnets disposed both in a light-up shuffleboard disc and below the surface of a shuffleboard court. In an exemplary implementation, a shuffleboard disc includes a small magnet carried on a spring contact arm which is configured to interact with magnets disposed below a surface of the shuffleboard court when the shuffleboard disc is positioned in one or more certain areas of the shuffleboard court, e.g. in areas associated with scoring points. When the shuffleboard disc is disposed in one of these areas, one or more magnets disposed below the surface of that area act on the magnet disposed within the shuffleboard disc. The magnet disposed within the shuffleboard disc is configured to complete an electrical circuit when acted upon by a magnet disposed below the surface of the shuffleboard court, thus effecting lighting of the shuffleboard disc.

Figure 14:
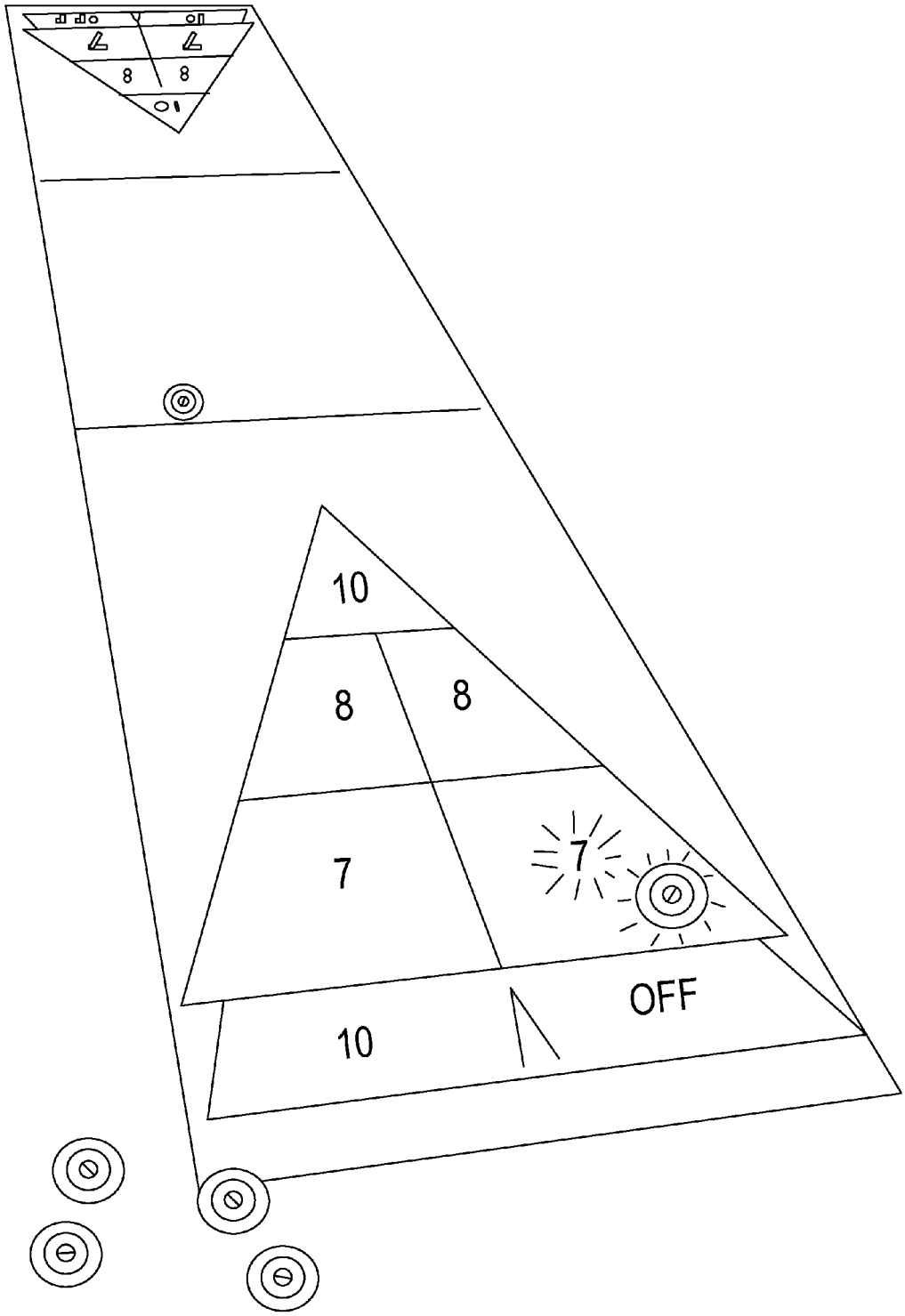

Similarly, magnets disposed in a shuffleboard disc may act on magnets disposed below a light-up shuffleboard court to effect lighting of one or more light sources of the light-up shuffleboard court. For example, the light-up shuffleboard court illustrated in FIG. 14 is configured to light up when a shuffleboard disc is disposed in a portion of a scoring zone, as illustrated with respect to the light-up shuffleboard disc disposed in the portion of the scoring zone associated with scoring seven points.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method for a light-up shuffleboard set comprising:

(a) inserting a lighting component into a cavity of a light-up shuffleboard disc such that (i) an activation button of the lighting component is disposed inside of the cavity, and (ii) threaded sidewalls of the lighting component engage threaded sidewalls of the cavity;

(b) rotating the lighting component relative to the light-up shuffleboard disc so as to cause the threaded sidewalls of the lighting component and shuffleboard disc to effect further insertion of the lighting component into the cavity of the light-up shuffleboard disc, such further insertion causing (i) a bottom of the lighting component to be generally flush with an outer surface of the light-up shuffleboard disc, and (ii) the activation button of the lighting component to come in contact with a surface of the light-up shuffleboard disc within the cavity thereby depressing the activation button;

(c) determining that a shuffleboard disc is disposed within a certain area of a shuffleboard court; and (b) in response to said determining step, automatically effecting lighting of a light source of the shuffleboard disc.

2. A method for a light-up shuffleboard set comprising:

(a) inserting a lighting component into a cavity of a light-up shuffleboard disc such that (i) an activation button of the lighting component is disposed inside of the cavity, and (ii) threaded sidewalls of the lighting component engage threaded sidewalls of the cavity;

(b) rotating the lighting component relative to the light-up shuffleboard disc so as to cause the threaded sidewalls of the lighting component and shuffleboard disc to effect further insertion of the lighting component into the cavity of the light-up shuffleboard disc, such further insertion causing (i) a bottom of the lighting component to be generally flush with an outer surface of the light-up shuffleboard disc, and (ii) the activation button of the lighting component to come in contact with a surface of the light-up shuffleboard disc within the cavity thereby depressing the activation button, which in turn activates a light of the lighting component;

(c) determining that the shuffleboard disc is disposed within a certain area of a shuffleboard court; and (b) in response to said determining step, automatically effecting lighting of a light source of the shuffleboard court.

3. The method of claim 1, wherein the lighting component comprises an incandescent light bulb.

4. The method of claim 1, wherein the lighting component comprises a light emitting diode (LED) bulb.

5. The method of claim 1, wherein the lighting component comprises a fluorescent bulb.

6. The method of claim 1, wherein a bottom of the cavity is partially defined by a planar surface, and wherein, when the lighting component is fully received within the cavity of the disc component, the activation button of the lighting component is depressed via contact with the planar surface.

7. The method of claim 1, wherein the light-up shuffleboard disc is at least partially transparent.

8. The method of claim 1, wherein the light-up shuffleboard disc is at least partially translucent.

9. The method of claim 1, wherein the light-up shuffleboard disc is colored.

10. The method of claim 1, wherein the lighting component is configured to emit colored light.

11. The method of claim 1, wherein the light-up shuffleboard disc is colored and the lighting component is configured to emit colored light.

12. The method of claim 2, wherein the lighting component comprises an incandescent light bulb.

13. The method of claim 2, wherein the lighting component comprises a light emitting diode (LED) bulb.

14. The method of claim 2, wherein the lighting component comprises a fluorescent bulb.

15. The method of claim 2, wherein a bottom of the cavity is partially defined by a planar surface, and wherein, when the lighting component is fully received within the cavity of the disc component, the activation button of the lighting component is depressed via contact with the planar surface.

16. The method of claim 2, wherein the light-up shuffleboard disc is at least partially transparent.

17. The method of claim 2, wherein the light-up shuffleboard disc is at least partially translucent.

18. The method of claim 2, wherein the light-up shuffleboard disc is colored.

19. The method of claim 2, wherein the lighting component is configured to emit colored light.

20. A method for a light-up shuffleboard set comprising:

(a) removing a lighting component from a cavity of a light-up shuffleboard disc by rotating the lighting component in a first direction relative to the light-up shuffleboard disc so as to cause threaded sidewalls of the lighting component and threaded sidewalls of the shuffleboard disc to effect withdrawal of the lighting component from the cavity of the light-up shuffleboard disc;

(b) replacing a battery of the lighting component;

(c) inserting the lighting component into the cavity of the light-up shuffleboard disc such that (i) an activation button of the lighting component is disposed inside of the cavity, and (ii) the threaded sidewalls of the lighting component engage the threaded sidewalls of the cavity;

(d) rotating the lighting component in a second direction opposite the first direction relative to the light-up shuffleboard disc so as to cause the threaded sidewalls of the lighting component and shuffleboard disc to effect further insertion of the lighting component into the cavity of the light-up shuffleboard disc, such further insertion causing (i) a bottom of the lighting component to be generally flush with an outer surface of the light-up shuffleboard disc, and (ii) the activation button of the lighting component to come in contact with a surface of the light-up shuffleboard disc within the cavity thereby depressing the activation button;

(e) determining that the shuffleboard disc is disposed within a certain area of a shuffleboard court; and (f) in response to such determination, automatically effecting lighting of a light source of the shuffleboard court.

* * * * *